United States Patent [19]

Sankus, Jr.

[11] 3,999,481

[45] Dec. 28, 1976

[54] METHOD FOR MAKING A MASTER

[75] Inventor: Joseph G. Sankus, Jr., Parker, Tex.

[73] Assignee: Xerox Corporation, Stamford, Conn.

[22] Filed: Nov. 15, 1974

[21] Appl. No.: 524,279

[52] U.S. Cl. ..... 101/451; 96/1.4; 96/1 R; 101/464; 101/401.1; 101/170; 101/426

[51] Int. Cl.[2] ..... G03G 13/14

[58] Field of Search ..... 96/1 R, 1.3, 1.4, 33, 96/35.1; 101/465, 466, 467, 451, 170, 401.1, 426, DIG. 13

[56] References Cited

UNITED STATES PATENTS

| | | | |
|---|---|---|---|
| 3,309,990 | 3/1967 | Kluptel | 96/1 R |
| 3,352,731 | 11/1967 | Schwertz et al. | 96/1.4 |
| 3,664,834 | 5/1972 | Amidon et al. | 96/1.4 |

*Primary Examiner*—David Klein
*Assistant Examiner*—John L. Goodrow
*Attorney, Agent, or Firm*—James J. Ralabate; Albert A. Mahassel; Donald M. MacKay

[57] ABSTRACT

A master is formed on a photoconductive surface by first forming an electrostatic charge pattern on the imaging member and developing the charge pattern to form an image of electroscopic marking particles. The developed image is uniformly coated with a thin layer of an adhesive coating and the coated image is then contacted with an adhesive surface transfer element. Upon separation the thin layer of adhesive overcoating fractures. The thin overcoating over the electroscopic particles and these particles transfer to the transfer element so as to leave on the photoconductive member the remaining thin overcoating layer in an image configuration which constitutes the master.

The master can be used to make copies by electrostatic, lithographic or gravure printing.

14 Claims, 10 Drawing Figures

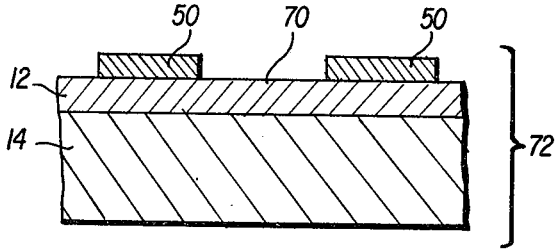
FIG. 7
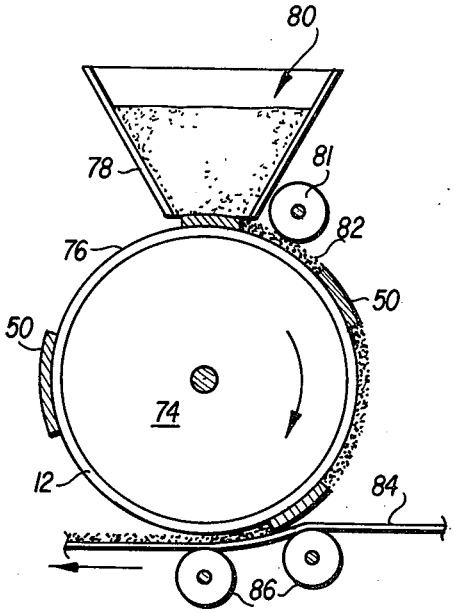
FIG. 8
FIG. 9
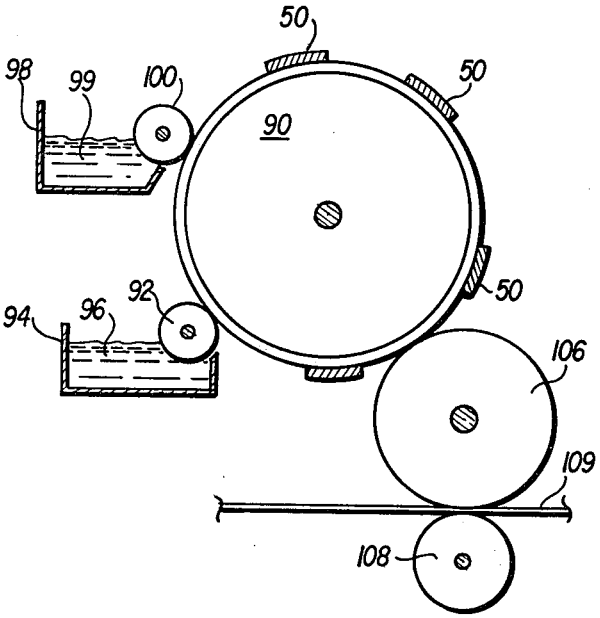
FIG. 10
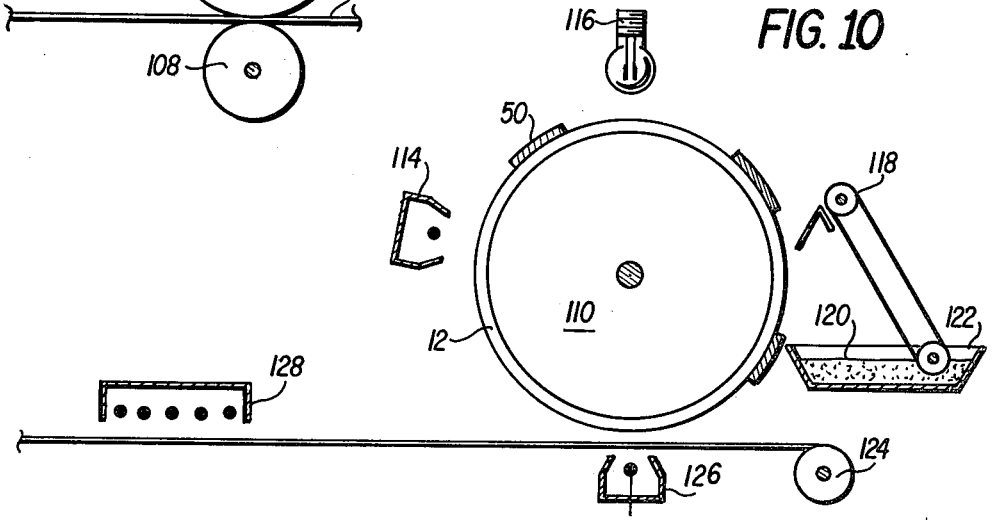

METHOD FOR MAKING A MASTER

BACKGROUND OF THE INVENTION

1. Field of the Invention

This invention relates to xerography and more particularly a xerographic method for preparing a master which can be used as a printing plate in either a gravure or lithographic mode or as a master to produce additional copies by xerographic techniques.

2. Description of the Prior Art

Lithographic printing is a well-known and established art. In general, the process involves printing from a flat plate, depending upon different properties of the image and non-image areas for printability. In conventional lithography the non-image area is hydrophilic while the image area is hydrophobic. In the lithographic printing process, a conversion solution is applied to the plate surface which wets all portions of the surface not covered by the hydrophobic image. This solution keeps the plate moist and prevents it from scumming up. An oil based printing ink is applied to the image surface depositing the lithographic ink only on the image area, the hydrophilic non-image area repelling the ink. The ink image may then be transferred directly to a paper sheet or other receptive surface, but generally it is transferred to a rubber off-set blanket which in turn transfers the print to the final paper sheet. Hence, for each print made during a run, the lithographic plate is first dampened with an aqueous conversion solution and then inked with a lithographic ink and finally printed.

It has been known that lithographic plates can be made in a photoconductive system by utilizing the conventional developed xerographic plate as a lithographic printing plate. The general process of utilizing a xerographic plate in a lithographic system is described in U.S. Pat. Nos. 3,107,169 and 3,001,872. In these systems, usually a zinc oxide-type plate is charged by conventional means, exposed to the image to be reproduced, and developed with conventional xerographic toner. The toner used is generally hydrophobic in nature as is the backgroun d of the conventional inorganic binder-type xerographic plate. In order that the developed xerographic plate be useful as a lithographic master, a differential must be established between the toned image and the background of the plate. Since both are hydrophobic nature, it has heretofore been required that the background of the xerographic plate be treated, by the use of a conversion solution, to make it hydrophilic in nature. After the conversion of the background, the plate is then wetted with a nonaqueous or oil based ink. The toner accepts the ink and the hydrophilic background repels the ink.

While basically this system has been found useful for lithographic purposes, there are inherent disadvantages to its use. One disadvantage, for example, is the fact that it requires a conversion solution to convert the initially hydrophobic background to a hydrophilic state so it will no longer accept the oil based ink during the inking step. A further disadvantage to this system is the lack of re-use of the zinc oxide type xerographic plate, since after the plate is developed and the toner fused, the plate can not be used again.

Other attempts have been utilized to produce a lithographic plate by removing the photoconductive layer upon which the initial xerographic image is formed. The photoconductive layer can be removed in the non-image areas by contacting the developed plate with an adhesive sheet as described in U.S. Pat. No. 3,446,616 or the photoconductive layer can just be removed from underneath the developed image area as described in Defensive Publication No. T878022. A further possibility is to completely remove all of the photoconductive layer by an adhesive surface transfer as described in Defensive Publication No. T878022.

The disadvantage of these photoconductive particle transfer methods is that a re-usable photoconductive layer cannot be employed. Furthermore, the production of each lithographic plate consumes nonreusable photoconductive particles which results in additional expense.

It is therefore an object of this invention to provide a master to be produced by xerography which can be employed in a lithographic mode to overcome the above noted disadvantages.

It is a further object of this invention to provide a novel method for the preparation of a lithographic master plate.

Another object of this invention is to provide an imaging system employing a re-usable photoconductive member which can serve as a master to make multiple copies without re-exposure to the original.

A still further object of this invention is to provide a method of producing a master in a quick and efficient manner which can be used in printing such as gravure printing.

Another object is to provide a master capable of producing additional copies by printing such as lithography, gravure or by xerography and at the same time producing a permanent record of the image.

These and other objects are achieved by the present method.

SUMMARY OF THE INVENTION

The present invention relates to a simple and easy method to produce a master for making multiple electrostatic copies as well as being suitable for use as a printing plate under a variety of printing techniques. A photoconductive member such as selenium is first charged and exposed to a light from an image to form a latent electrostatic charge image. This latent image is developed with a particulate toner such as in a liquid developer and the particles deposit in image areas. The entire image bearing member is then overcoated with an adhesive material which can be applied in the form of an adhesive solution and is dried. The overcoating adhesive adheres to both the photoconductive member in the non-image areas and to the toner particles in the image areas.

The toner image areas and the overcoat material above the toner are removed with a transfer member having an exposed adhesive surface. This transfer member is placed in adhesive contact with the entire overcoated imaging member and pressure is applied. Upon separation the overcoat fractures between the image areas and the non-image areas and the overcoat transfers from the image areas along with the toner image. The master is formed by the overcoating material remaining in the non-image areas on the photoconductive member.

The master can be employed as a gravure printer plate due to the depressions formed in the image areas between the raised overcoated areas that remain in the non-image regions. These depressions defining the image area can be filled with ink and this ink pattern can be transferred to the paper to be printed.

By the proper selection of the developer used to develop the charge image, the toner can be deposited in the background areas to produce a reversal image. The master obtained from this reversal image will have the remaining plastic overcoat sections in what will correspond to the dark image areas of the original. These masters can then be employed in one of three modes.

First, in the case where the master has a thick overcoat layer which results in significantly raised image areas, it can be linked by conventional gravure techniques to produce multiple copies.

Secondly, the master can be employed as a lithographic master by initially applying an aqueous fountain solution which will adhere to the non-coated areas on the photoconductor and then applying a lithographic ink which will adhere to the coated areas and which can then be transferred to the paper to be printed.

Thirdly, the photoconductive master with its image defined by the remaining overcoated adhesive can be employed as an electrostatographic master. It can be either uniformly recharged and then subjected to sufficient illumination to discharge only the uncoated portion of the photoconductive layer or it can simultaneously be charged in an illuminated condition to produce a charge image. The residual charge on the coated portion can then be developed and transferred to a receiving sheet and this process can be repeated to produce many copies.

After a master has been used to make the necessary number of copies, a mild solvent solution can be applied to the photoconductive surface to remove the adhesive coating material in order to reuse the photoconductor.

BRIEF DESCRIPTION OF THE DRAWINGS

FIG. 1–7 schematically represent the production of the novel master.

FIG. 8 schematically represents the use of the master in gravure printing.

FIG. 9 schematically represents the preferred embodiment in lithographic printing.

FIG. 10 schematically represents the preferred embodiment in electrostatic printing.

DESCRIPTION OF THE PREFERRED EMBODIMENT

Figure 1:
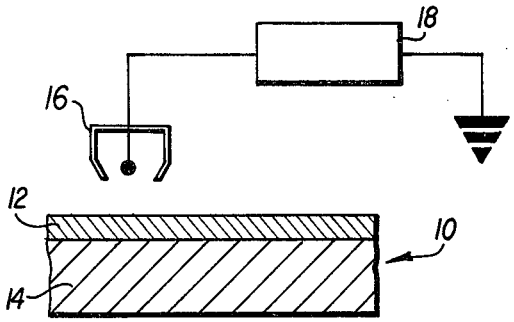

FIG. 1 schematically represents a conventional xerographic plate 10 comprising a conductive backing material 14 and a photoconductive insulating layer 12. This xerographic plate is uniformly charged by corona 16 with power supplied by a high power source 18. The corona unit is in charging relation with and relative to plate 10 to apply a substantially uniform electrostatic charge. As is usual in xerography, plate sensitization is carried out in darkness to retain the electrostatic charge on the photoconductive layer 12.

Figure 2:
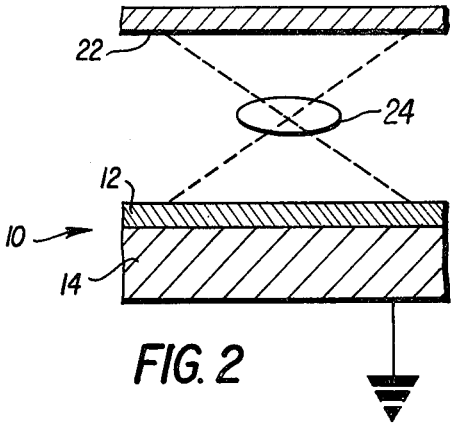

FIG. 2 illustrates the exposure of the sensitized plate to a pattern of light and shadow corresponding to the image to be formed. Lens 24 is shown focussing an optical image of the original 22 (which comprises, for example, a document or three dimensional subject to be reproduced) on a photoconductive layer 12. Since the photoconductive layer is rendered relatively more conductive in the illuminated areas, plate 10 becomes selectively discharged and a latent electrostatic image is formed in accordance with the optical image.

Figure 3:
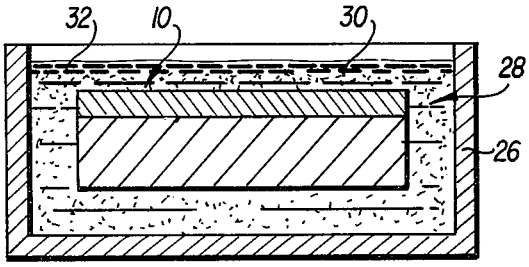

FIG. 3 illustrates one method for developing the latent electrostatic charge image by immersing the image in tank 26 containing developer 28 of electroscopic particles 30 suspended in a relatively non-conducting liquid carrier 32. The toner particles can be selected to adhere to either a positive or negative electrostatic image or to be repelled by a charge image so as to be deposited in those areas where there is no charge. Similarly the electrostatic charge image initially produced by the corona can be either positive or negative. As a result of controlling the polarity of the initial charge and the predetermined electrical properties of the developer particles, the plate 10 can be developed with toner particles which will be attracted to either the charged or the uncharged areas of plate 10. Although this liquid method for developing in illustrated in FIG. 3, other conventional developing methods known in the xerographic art such as cascade development which is described in U.S. Pat. Nos. 2,618,551 to Walkup, 2,618,552 to Wise, and 2,638,416 to Walkup and Wise may be employed. Other techniques include brush development as described in U.S. Pat. Nos. 2,975,758 to Bird and 2,880,699 to Simmonds; liquid spray development as described in U.S. Pat. No. 2,551,582 to Carlson; loop development as described in U.S. Pat. No. 2,761,416 to Carlson; donor development as described in U.S. Pat. No. 2,895,847 to Mayo and powder cloud development as first described by Carlson in U.S. Pat. No. 2,217,776.

When a liquid developer is employed, the developed image can be either allowed to dry in the air or heating means such as a forced air heater can be used to obtain rapid drying. If the image is developed with a solid, dry toner, then the developed image can be subjected to flash fusing to cause the particles to coalesce.

Figure 4:
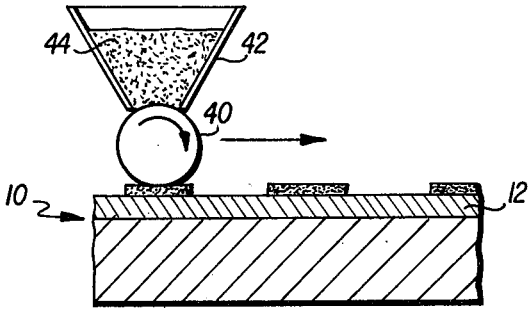

FIG. 4 illustrates one method applying an overcoat of an adhesive material by roller 40 which is supplied with adhesive material 44 in an adhesive supply container 42. The roller is rolled along the surface 12 to provide a uniform layer of the adhesive overcoating. The thickness of the coating can be on the order of from 5 to 25 microns. If it is such as one micron or less or even up to 2 microns, too thin, the coating will adhere too well to the photoreceptor due to surface phenomenas including molecular orientation such that a satisfactory fracture is not obtained. Similarly if the overcoating thickness exceeds 1 mil or 25 microns, it approaches the thickness of a paint layer and an orange peel effect is observed in which sharp, clear fractures are no longer obtained. These thicker layers are not satisfactory since they become self-supporting films which behave like chips when they are broken off.

This adhesive can be applied by any equivalent method known in the coating art such as by allowing a puddle of liquid to flow over the plate, by spraying the adhesive from an aerosol can or an atomizer, or applying the adhesive coating with a brush or doctor or any other known device for applying a uniform coating to a substrate.

The overcoat material can be a polymer type material which is dissolved in a solvent to form a mildly viscous solution which is flowable over the substrate. Since one of the uses of the plate is in electrostatic imaging, it is preferred to use a plastic with a good electrical resistivity in the order of $10^{10}$ ohm cm or greater. A surfactant can be added to the resin solution and the amount added should be controlled. The surfactant affects the wetability of the surface; if too much is added the overcoat layer will resist adhesion to the adhesive member which will be applied. The molecular weight of the polymer can be varied. However, with higher molecular weight polymers the viscosity of the coating solution increases which will cut down the flow and result in a slower system and a thicker coating.

The solvent for the polymer is not critical. It can be either an aromatic or long chain hydrocarbon solvent.

Figure 5:
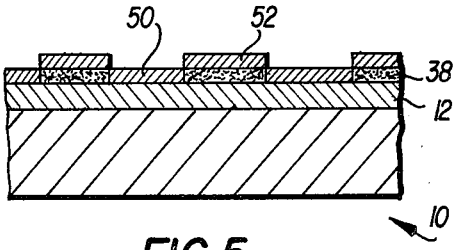

FIG. 5 illustrates the coated product obtained with the toner image areas 38 and a uniform coating of the adhesive layer. This overcoat layer adheres to the photoconductive member 12 in the non-image areas as shown at 50 and it adheres to the toner particles in the image areas as shown at 52.

Figure 6:
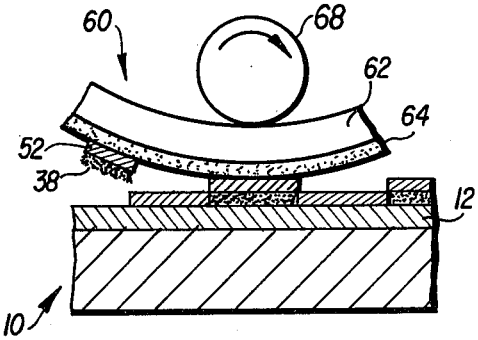

FIG. 6 illustrates the novel stripping process of the present invention in which an adhesive surfaced member 60 having a backing support 62 with an adhesive coating 64 thereon is placed in contact with the xerographic plate 10 by a pressure roller 68.

The adhesive surface 64 of the transfer member adheres to the overcoat layer 52 in the image areas since the overcoat layer 52 did not make an adhering contact with the photoconductive layer 12 due to the presence of the toner particles 38 which act as a release material. Other techniques may be used to place the adhesive transfer member in contact with the xerographic plate 10 including a flat press or even pressing by hand. The adhesive surface 64 can be in the form of a tacky surface or in the form of a heat activated adhesive which is not tacky at room temperature but which becomes tacky upon being heated. It must also have a low enough surface energy to "spread or wet" the overcoat layer. In this case, the sheet can either be heated before use or the roller 68 can be provided with a heating element to heat the sheet.

The amount of pressure required is not very large. By manual effort on a roller, nip pressures of from 8 to 10 lbs. per linear inch can be obtained which are entirely satisfactory. The criteria is merely to have a good firm contact in order to remove any air bubbles. A nip pressure of approximately 5 lbs or higher should ensure good contact.

The adhesive employed in the transfer member must be compatible with the plastic in the overcoat layer to the extent that it will adhere to the overcoat layer and cause it to fracture in those areas where the overcoat layer is above the toner image. The adhesive is not to adhere, however, to the overcoat layer which is adjacent the photoreceptor surface.

The transfer sheet 60 after removal has a permanent record of the toner image in the form of a mirror image. When the backing 62 is made of clear mylar, the transfer member can be viewed from the mylar side to obtain a right reading image. Since the adhesive side is still tacky on the background areas, this member can be stored in a dust-free glassine envelop to preserve the image. Other containers could be used to store the image or a backing sheet could be laminated on to the adhesive surface to permanently protect the image.

FIG. 7 illustrates the master 72 which is obtained after contact with the adhesive transfer sheet 60. The overcoat layer 50 remains in those non-image areas where the toner particles were not present. In the image areas the toner particles have been removed by the adhesive transfer member 60 leaving the uncoated areas 70 on the photoconductive layer 12. The remaining coated areas 50 have different surface properties than those of areas 70 and thus master 72 can be used as a lithographic printing plate.

FIG. 8 schematically illustrates one method of using this new master in a cylindrical configuration. Drum 74 has the outer photoconductive layer 12 with the remaining overcoated image areas 50 which outline the depressed image areas 76. An ink supply hopper 78 with ink 80 is placed closely adjacent to drum 74 so that the ink can fill in the voids 76 but does not deposit on top of the raised areas 50. A squeeze roller 81 can be used to control the loading. The ink filled areas 82 are then brought in contact with a sheet 84 which is fed in contact with the drum by rollers 86. The ink can either fall out by gravity on to the sheet or an additional force can be exerted such as by an electrostatic field to aid in the complete transfer of the ink to the sheet. The drum is then rotated to complete the cycle to make as many copies as desired.

FIG. 9 schematically illustrates another method of using this new master in a cylindrical configuration as a lithographic printing plate. The cylinder 90 having an outer photoconductive layer 12 has thereon the remaining overcoat areas 50 defining an image. The drum 90 rotates to a first station where roller 92 applied an aqueous fountain solution 96 from container 94 onto the non-coated areas of the photoconductive drum. The lithographic ink 99 is applied by roller 100 from supply 98. This ink adheres only to the coated areas 50. The ink image on these coated areas 50 is then transferred to transfer roller 106 which can be a rubber roller which in turn transfers the ink image to sheet 109 as the sheet passes between roller 106 and support roller 108.

FIG. 10 schematically illustrates the further employment of this new master to obtain multiple copies by xerographic development and transfer. Here a photoconductive surface 12 is arranged around a cylindrical drum 110 with the remaining adhesive overcoating image deposits 50. The drum rotates past a corona charging unit 114 to uniformly apply an electrostatic charge. The charged surface is uniformly exposed to light 116 to dissipate the charge in the uncoated photoconductive areas. The charge does not dissipate, however, on the areas of the insulating coated image 50. The remaining electrostatic charged image on the coated areas 50 is then developed by a conventional development system such as by cascade development in which a mixture of toner and carrier particles 120 in supply container 122 are fed by conveyor 118 up to a position where they will cascade over the drum surface to develop the charge image. This developed image of toner particles is then transferred to the paper 124 by an electrostatic attraction produced by corona 126. The image on the paper 124 can then be fused by a conventional fusing unit such as an infrared heater 128 in order to obtain a permanent copy of the image.

After the master has been used to make the required number of copies, the plastic deposits on the photoreceptor can be removed by contacting the surface with any conventional conventional solvent for the plastic. Among the materials which may be used are aliphatic long chain solvents such as Petroleum distillates
Coal tar distillates
Chloroform
Carbon tetrachloride Petrolatum
Paraffin wax
which are generally non-polar hydrocarbon solvents and aromatic solvents such as
Toluene
Xylene
Benzene The following example is illustrative of the present invention, but limitation to the specific materials and xerographic processing steps should not be inferred. A wide variety of equivalents may be employed without departing from the invention as defined in the appended claims.

EXAMPLE

A photoreceptor made of selenium and arsenic alloy is initially charged and exposed to light to form a latent image. The latent image is developed with a liquid developer composed of carbon black and a cyclized rubber made by the Reichhold Chemical Company and sold under the trademark Alkadol 44-800. This particulate material is suspended in Dryolene which is an aliphatic solvent made by the APCO Oil Company. The image is dried using warm forced air. The entire image area is then flow coated with the following solution to produce a thin coating of 1 mil thickness or less.

| | Weight |
|---|---|
| polyisobutylene solution (2½% by weight Vistanex L-80 in VMP Naphtha) | 10 g. |
| VMP Naphtha (Dryolene) | 90 g. |
| Surfactant (Igepal CO-710) | 0.6 g. |
| Isopropanol | 1 g. |

The Vistanex L-80 is a polyisobutylene resin produced by the Enjay Chemical Company. Dryolene is an aliphatic hydrocarbon solvent sold by the APCO Oil Corporation and the Igepal CO-710 surfactant is a nonionic type surfactant of a polyoxyethylated nonyl phenol made by the GAF Company.

This layer is also forced dried with heated air. This dry coated surface is then contacted with a Mylar sheet having a thickness of from 3 to 5 mils which is coated with an adhesive polyester No. 49001 made by the Dupont Company. Manual pressure is applied and upon separation the overcoated layer fractures and the toner image with its overcoated layer are removed from the selenium surface. The photoreceptor surface image area is completely clean while in the non-image (background) areas, the thin layer of Vistanex L-80 polymer remains to form the master which can then be used with either gravure, lithographic or or electrostatic techniques to produce multiple images.

In addition to the Vistanex L-80 overcoating material other polymeric materials could be employed for the overcoat layer with proper surfactants and/or variations in film thickness. They include 1. Polyox (polyethylene oxide)
2. "EDEN" (vinyl ethyl ether resin); Hercules Co.
3. Nitrocellulose
4. Polyvinyl chloride
5. PCL 7092 (conductive polymer)
6. "Acrylene" (latex dispersion)
7. Polystyrene (high molecular wt.)

The adhesive material on the transfer member can also be selected from a broad range of adhesives as long as it has the proper compatability with the specific overcoating material. The choice of adhesive material will be dictated by whatever the overcoat layer will be.

As to the lithographic mode, when Vistanex L-80 is used as the overcoat layer, an oil based fluid (or ink) will "wet" that surface while a combination of an alcohol and water fluid could be employed to reside on exposed areas of the photoreceptor. Using this mode it would be preferred to use a reversal (or negative) toner image and from the resultant master be able to print positive (or direct) images.

What is claimed is:

1. A method of forming a master on a photoconductive surface comprising:
a. forming an electrostatic charge pattern on the surface of a photoconductive imaging member;
b. applying a xerographic developer to said member bearing the charge pattern to form an image composed of electroscopic marking particles;
c. uniformly coating said particles and said member with a thin layer of an adhesive coating;
d. contacting said coated member with an adhesive surface transfer element and separating said transfer element whereby the thin layer of adhesive overcoating fractures with the electroscopic particles and the associated overcoating being transferred to the transfer element to leave remaining on the photoconductive member said thin layer in the noimage areas to form a master.

2. The method of claim 1, wherein said thin layer of an adhesive coating has a thickness of from about 5 to about 25 microns.

3. The method of claim 1, wherein the coating material of step (c) comprises polyisobutylene and a surfactant.

4. The process of claim 3, wherein said thin layer of polyisobutylene has a thickness of from about 5 to about 25 microns.

5. The method of claim 1, wherein said electrostatic charge pattern is developed with a liquid developer.

6. The method of claim 5, wherein said liquid developer comprises cyclized rubber and carbon black suspended in a solvent.

7. The method of claim 1, wherein said adhesive surface transfer element has a surface composed of polyester.

8. The method of claim 1, wherein said thin layer of adhesive coating has an electrical resistivity in the order of 10 ohm cm or greater.

9. The method of claim 1, wherein the contacting of step (d) is done at a nip pressure of approximately 5 lbs. or higher.

10. The method of claim 1, wherein said adhesive surface transfer element is transparent.

11. A process according to claim 1, wherein said master is employed to make additional copies on receiving sheets.

12. A method according to claim 11, wherein said master is charged and exposed to light, developed with an electroscopic developer and the developed image is transferred to a receiving sheet.

13. A method according to claim 11, wherein said master is wetted with an aqueous fountain solution, inked with a lithographic ink and the sheet image is transferred to a receiving sheet.

14. A method according to claim 11, wherein said master is employed as a gravure printing element by loading the depressed areas between the remaining thin layer of said adhesive coating with ink and transferring the ink image pattern to a receiving sheet.

* * * * *